United States Patent [19]

Tutusaus Almao

[11] 4,104,754

[45] Aug. 8, 1978

[54] PROCESS FOR THE MANUFACTURE OF SHOES HAVING A WOODEN BASE

[76] Inventor: Jose Maria Tutusaus Almao, Diagonal 674 - 1º 2ª, Barcelona, Spain

[21] Appl. No.: 767,634

[22] Filed: Feb. 10, 1977

[30] Foreign Application Priority Data

Dec. 2, 1976 [ES] Spain ..... 453.882

[51] Int. Cl.[2] ..... A43D 9/00; A43C 13/00; A43B 13/08

[52] U.S. Cl. ..... 12/142 S; 36/13; 36/33

[58] Field of Search ..... 36/11.5, 13, 86, 33; 12/142 S, 146 B

[56] References Cited

U.S. PATENT DOCUMENTS

| | | | |
|---|---|---|---|
| 2,252,216 | 8/1941 | Sterzik | 36/13 |
| 2,347,762 | 5/1944 | Bergman | 36/13 |
| 2,364,763 | 12/1944 | Sutcliffe | 36/13 |
| 2,367,537 | 1/1945 | Sterzik | 36/13 |
| 2,588,061 | 3/1952 | Sterzik | 36/11.5 |

*Primary Examiner*—Patrick D. Lawson
*Attorney, Agent, or Firm*—Wenderoth, Lind & Ponack

[57] ABSTRACT

A shoe having a wooden base is manufactured by providing a wooden member having a shape corresponding to the desired shape of the insole and sole of the finished shoe. The wooden member is divided along a line substantially parallel to the foot supporting surface of the shoe, thus forming a wooden strip or insole in which a series of openings and recesses are made parallel and adjacent to the edges thereof. The recesses extend in opposite directions toward each other and receive small lateral flap-like extensions provided in the front and heel upper portions of the shoe. The lateral flaps are passed through the openings and introduced into the recesses.

1 Claim, 4 Drawing Figures

PROCESS FOR THE MANUFACTURE OF SHOES HAVING A WOODEN BASE

BACKGROUND OF THE INVENTION

The present invention relates to a process for the manufacture of shoes having a wooden base, which process provides remarkable improvements and advantages with respect to known processes for the manufacture of shoes.

Many shoes are at present being manufactured with a wooden sole to compete, insofar as their finish and design are concerned, with shoes which are made from different materials and processes, such as skin, leather, etc.

It is clear that the conventional construction of the shoe having a leather sole and insole cannot be used in the manufacture of shoes having a wooden base. Therefore, special processes and techniques have always been used. Thus, for example, due to the difficulties of securing the upper to the base of the shoe, the upper was discarded, the base of the shoe was raised by means of blocks, and the shoe was secured to the foot by means of belts.

Also, there has been used a wooden base provided with transverse holes which form passageways for belts or bands which, joined to the foot of the user, secured the assembly.

On the other hand, and in an attempt to proportion a shoe having a wooden base with a conventional appearance, various tests have been carried out, so that on a wooden piece designed to act as the shoe sole, there have been made a series of holes parallel to the sole edge, which holes at their lower surface lead into a groove. The purpose of the holes is to permit stitching of the upper of the shoe to the wood base, while the groove serves the purpose of housing the stitching cord, so that the cord is not worn out by the friction of the lower surface of the shoe against the sole.

This known process presents important difficulties in realization, due to the fact that the bases and the height of the heel complicate the piercing and stitching operations, and also due to the fact that a posterior complete covering of the lower surface of the shoe must be added so that the stitching is not visible. Therefore, a shoe wherein the upper is not extended to the heel was designed, and also shoes of the "chanclos" (open-heel sandals) type were made, i.e. with only a forward upper instead of a complete upper since, due to the open heel design, the highest part of the base, i.e. the heel, need not be pierced.

This arrangement presents two important inconveniences:

1. Sewing of the partial upper is slow and too much cord is consumed.

2. The holes and groove weaken the base, making it fragile.

SUMMARY OF THE INVENTION

These inconveniences have been overcome by the process for the manufacture of a wooden shoe according to the present invention, such process including the following steps:

A. Providing a wooden monopiece base member having substantially the desired shape of the shoe when it is finished.

B. Dividing the wooden base member to separate therefrom a strip or insole along a line substantially parallel to the surface which will act as the support for the foot.

C. Forming in the strip or insole a series of elongated openings parallel to the edges of the insole, and forming recesses on the bottom surface of the insole, such that the recesses join the openings laterally inwardly thereof.

D. Providing front and heel upper portions with lateral extensions, the width dimensions of which are not greater than the length of each of the openings made in the wooden strip or insole.

E. Mounting the uppers of the shoe on the strip or insole by introducing into the openings the extensions of the uppers, and folding the extensions beneath the insole so that they are housed in the lateral recesses.

F. Mounting the strip or insole on the base or sole from which it was cut, and solidly fastening both the insole and sole together by conventional means.

G. Performing the operations of polishing, surface finishing, and trimming of the sole, insole and heel until the shoe itself is finished.

Insofar as the first step of the process for the manufacture of the shoe is concerned, i.e. the step of providing a wooden monopiece base member, any type of wood can be used, although the base member is preferably obtained by overlapping pressed and adhered boards.

The strip or insole should be cut along a line or path substantially parallel to the surface which will act as a support for the foot, thus ensuring a more efficient fastening between both mounted parts, although the parallelism need not be precise.

BRIEF DESCRIPTION OF THE DRAWINGS

To complement the description which will subsequently be made and for a better understanding of the characteristics of the invention, reference is made to the accompanying drawings, wherein.

DETAILED DESCRIPTION OF THE INVENTION

Figure 1:
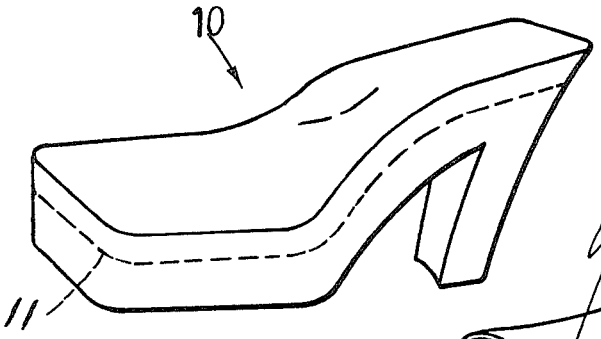
FIG. 1 is a perspective view of a wooden monopiece base configured to have the desired shape of a finished shoe, and illustrates schematically a cut line used to divide the monopiece base into a base or sole portion and a strip or insole portion.
Figure 2:
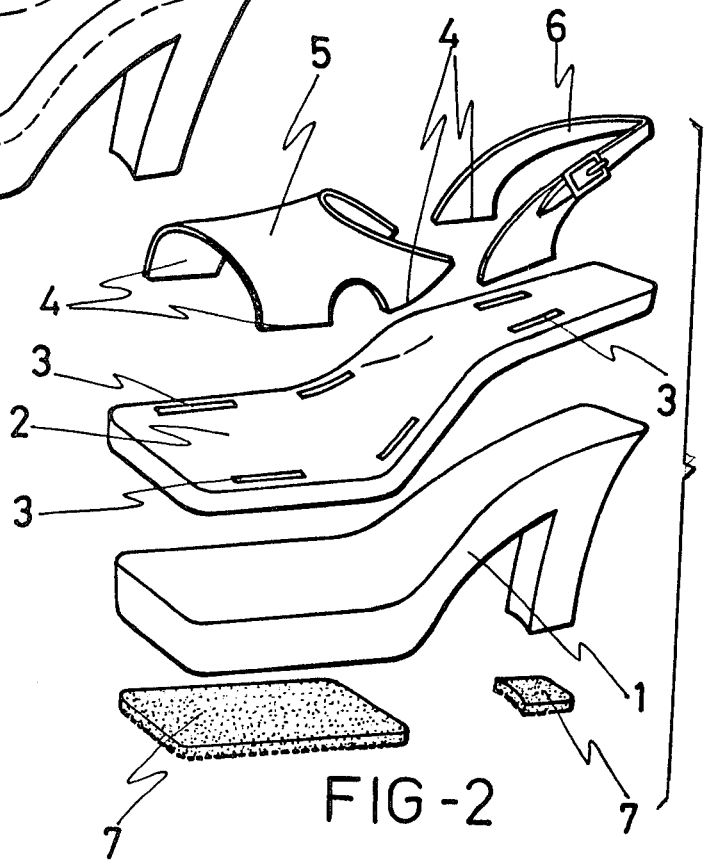
FIG. 2 is an exploded perspective view of the different parts or elements which form the shoe itself, i.e. the sole and insole formed from the wooden monopiece base, upper portions having extensions adapted to fit through openings in the insole and into recesses therein, and non-slip material which may be applied to the surface contacting areas of the bottom of the sole.
Figure 4:
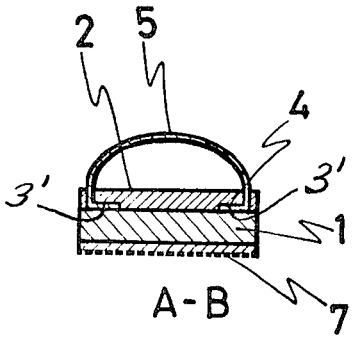
FIG. 4 is a section taken along line IV—IV of FIG. 3.
Figure 3:
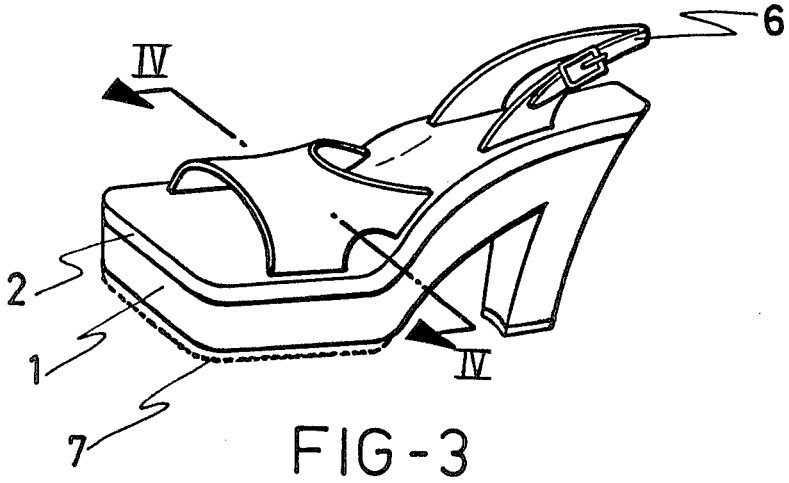
FIG. 3 is a perspective view of a finished shoe made in accordance with the process of the present invention.

The aforementioned Figures illustrate the wooden monopiece base 10 having a configuration corresponding to the desired shape of the finished shoe. The wooden monopiece base 10 is divided along a line 11 corresponding generally to the slope of the upper surface of the shoe, to form a wooden sole 1 and a wooden insole 2 having adjacent parallel surfaces. Openings 3 are provided through insole 2, and openings 3 are recessed as at 3' to form recesses opening onto the bottom surface of insole 2. The shoe includes front and heel upper portions 5 and 6, respectively, each having extensions 4 dimensioned to be extended through openings 3 and bent inwardly into recesses 3'. The extensions 4 are introduced through the openings 3 of the strip or insole 2, and extensions 4 are folded beneath insole 2 to be housed in the lateral recesses 3'. Thus, the positions of shoe upper portions 5 and 6, to ensure correct shoe size, are precisely fixed.

Once the position of the upper portions 5 and 6 of the shoe are fixed with respect to strip or insole 2, the bottom surface of the insole 2 is then attached to the top surface of sole 1, solidly fastening both pieces together by conventional means.

Subsequently, the operations of polishing, surface finishing, and trimming of the insole, sole and heel may be carried out, until the shoe is finished, and then sheets 7 of slip-preventing material may be applied to the bottom of the shoe.

I claim:

1. A process for the manufacture of shoes having a wooden base, said process comprising:

providing a wooden monopiece base member having a configuration corresponding to the desired shape of a finished shoe;

cutting said base member along a path substantially parallel to the upper surface thereof which will act as the support for the foot of the user, to thereby form a sole portion and a strip-shaped insole portion;

forming a plurality of elongated openings through said insole portion at positions therein parallel with the edge thereof;

forming recesses in the bottom surface of said insole portion such that said recesses join said openings and extend therefrom inwardly of said insole portion;

providing front and heel shoe upper portions with flap-shaped extensions;

attaching said upper portions to said insole portion by passing each of said extensions through a corresponding said opening, and then bending the end of said extensions inwardly of said insole portion so that said extension ends are completely housed within corresponding said recesses; and rigidly fastening said insole portion to said sole portion such that the bottom surface of said insole portion is in contiguous contact with the upper surface of said sole portion.

* * * * *